US006143134A

United States Patent [19]

Prough

[11] Patent Number: 6,143,134

[45] Date of Patent: Nov. 7, 2000

[54] CHIP SPREADER FOR AIR-LOCK FEEDER

[75] Inventor: J. Robert Prough, Glens Falls, N.Y.

[73] Assignee: Andritz-Ahlstrom Inc., Glens Falls, N.Y.

[21] Appl. No.: 09/425,053

[22] Filed: Oct. 22, 1999

Related U.S. Application Data

[60] Provisional application No. 60/107,323, Nov. 6, 1998.

[51] Int. Cl.[7] ..... D21C 7/12

[52] U.S. Cl. ..... 162/238; 162/246; 162/52; 162/17; 34/482; 34/484; 34/524; 34/165; 222/185.1; 222/190

[58] Field of Search ..... 162/238, 246, 162/52, 17; 222/185.1, 190, 181, 504; 141/130, 286; 34/482, 484, 524, 165, 168

[56] References Cited

U.S. PATENT DOCUMENTS

| | | | |
|---|---|---|---|
| 3,946,909 | 3/1976 | Wheeler | 222/181 |
| 4,927,312 | 5/1990 | Meredith | 414/221 |
| 5,547,546 | 8/1996 | Prough | 162/236 |

FOREIGN PATENT DOCUMENTS

WO 96/17124 6/1996 WIPO .

*Primary Examiner*—Stanley S. Silverman
*Assistant Examiner*—Mark Halpern
*Attorney, Agent, or Firm*—Nixon & Vanderhye P.C.

[57] ABSTRACT

By establishing a relatively flat, for example, non-sharply conical, top profile of wood chips in a treatment vessel (such as a chip bin), the chips will be more uniformly steamed or otherwise treated (or have the treatment time of the chips extended) compared to if a conventional sharply conical top profile is established in the treatment vessel. The relatively flat top profile of the chips in the treatment vessel is established by utilizing a plurality (typically at least three, and preferably four or more) individually controlled gates (typically having a substantially polygon shape, such as triangular). The gates are mounted below the inlet of chips into a treatment vessel so to deflect, not significantly affect, or substantially preclude the flow of chips past them into the vessel depending upon the positions of each. An individual actuator is provided for each of the gates, such as a pneumatic piston and cylinder assembly, and the actuators are typically automatically controlled either by a controller including a timer, which opens and closes the gates in a predetermined established sequence and for a particular period of time (typically ranging between about one second-ten minutes), and/or utilizing a sensor for sensing the level of material in the treatment vessel (for example a plurality of sensors disposed around the treatment vessel for sensing the top profile of the pile of chips in the vessel).

27 Claims, 3 Drawing Sheets

CHIP SPREADER FOR AIR-LOCK FEEDER

CROSS-REFERENCE TO RELATED APPLICATION

This application is based upon provisional application Ser. No. 60/107,323 filed Nov. 6, 1998, the disclosure of which is incorporated by reference herein.

BACKGROUND AND SUMMARY OF THE INVENTION

The manufacture of cellulose paper products typically begins with the wood chip. Though cellulose pulps from which paper is made can be manufactured from a variety of cellulose materials, including grasses, agricultural waste, hemp, sawdust, etc. as well as recycled papers, the predominant form of cellulose that is treated in modern pulp mills is the wood chip. These chips vary in length and width from 25 to 50 mm or more but are typically less than 10 mm in thickness, for example, from 4 to 8 mm in thickness. Wood chips are typically introduced to the pulping process via some form of isolation device or air-lock in order to minimize the escape of heat and gases from the process as the chips are introduced (see U.S. Pat. No. 5,547,546, incorporated by reference herein).

One typical process that chips undergo after they are introduced to the pulping process is steaming. Steaming, that is, the exposure of the chips to steam in a retention vessel, has several functions. The steam begins the heating process that culminates in the chips achieving a pulping temperature of between about 140–180° C. Steaming, more importantly, displaces the air that is naturally present in the cavities within the chip. The removal of the air, or de-aeration, of the chips insures that the chips will not impose a buoyant force, that is, they will not tend to float, during aqueous treatment. Steaming, and the consequent condensation of the steam in the chip, also enhances the penetration or impregnation of cooking chemical into the chip. Since de-aeration and impregnation are critical to the quality of the pulp produced, adequate or proper steaming is essential when producing pulps for the paper markets of the late 20th century and the new millennium.

However, proper steaming of wood chips is not easy to achieve, especially continuously in a retention vessel through which chips pass for a limited amount of time. Wood chips, as described above, can have varied geometries and do not lend themselves to uniform passage through vessels, especially when the chips are discharged via restricted outlets. Special vessel geometries or agitation is typically required to continuously pass chips through cylindrical vessels, for example, the geometries described in U.S. Pat. Nos. 5,500,083; 5,617,975; 5,628,873; 4,958,741; and 5,700,355, and marketed under the name Diamondback® by Ahistrom Machinery Inc., of Glens Falls, N.Y., which do not require agitation or vibration to uniformly pass wood chips in a "plug flow" regime. Even when handled by vessels or bins having the geometries described in these patents it can still be difficult to expose the chips to steam for sufficient length of time to ensure adequate de-aeration and impregnation.

Typically, chips are introduced to the steaming or retention vessel via a centralized inlet, for example, by an air-lock-type gate located in the top cover of a cylindrical vessel. The chips thus typically fall along the centerline of the vessel and form a conical pile in the middle of the vessel. Depending upon the character of the chips, the angle of this conical pile, that is, the angle of repose, is typically about 40–50°. The steam with which the chips are treated is typically introduced via one or more nozzles uniformly distributed about the circumference of the vessel and at an elevation below the conical chip pile, that is, at a point below where the chip pile touches the vessel wall. The steam then passes upward through the chip mass to heat, de-aerate and impregnate the chips. This heating, deaeration and impregnation typically requires a minimum retention time to allow the steam to diffuse into the chips and the steam to condense in the chips. This retention time is typically defined by the distance between the steam inlet nozzles and the elevation at which the width of the bin is completely filled with chips. Above this point, the steam will exit the chip pile by following the path of least resistance. When the chip pile is conical in shape, this path is typically not through the conical pile above but undesirably through a side of the conical pile. Thus, some of the chips in the conical pile are not exposed to steam as long as desired. The steam that passes through the chip pile exits the bin through an outlet in the top cover of the bin. Thus, the conical pile of chips at the top of the bin typically is not as uniformly exposed to steam as the chips below the conical pile. If possible, it is therefore desirable to reduce the height of the conical chip pile as much as possible to minimize the time that the chips are not exposed to steam. Since the chips are typically introduced through a central inlet, it is difficult to change the geometry of the chip pile without imposing some external mechanism for distribution of the chips across the bin cross-section.

As the chips are introduced to the vessel, it is also desirable to provide the most uniform distribution of chips such that a uniform downward load is exerted on the chip mass below the top of the chip pile. An uneven distribution of chips can produce an uneven load on the chip pile which can promote a non-uniform movement of the chip mass below. In the worst case, an uneven chip load can cause a flow regime referred to as "rat-holing" in which the flow is limited to localized regions and the flow stagnates elsewhere. This undesirable flow regime can result in non-uniform treatment of the chips in the vessel and in extreme instances can result in a plugged vessel having no material flow.

Another desirable feature of an air-lock or a device for introducing wood chips, or other comminuted cellulosic fibrous material, to a vessel is to have the chips introduced along the centerline or axis of the vessel such that a uniform, for example, conical, chip pile is produced. In other words, it is desirable to produce a pile of material in the vessel that is axially symmetric such that little or no non-uniform loading is produced which can produce non-uniform flow and non-uniform treatment of the material in the vessel. Though the synchronized chip gates of PCT publication WO 96/17124 promote this uniform feeding of chips, this prior art, having only two gates, has a limited capability of providing the desired distribution. The multiple gate embodiment of the present invention, for example, having three or more controllable gates, provides a better mechanism for establishing a chip pile in the vessel which is more axially symmetric about the axis of the vessel and which provides a more uniform load on the chip mass below.

According to one aspect of the present invention there is provided a method of treating comminuted cellulosic fibrous material, including by controlling the top profile of comminuted cellulosic fibrous material established in a treatment vessel having an isolation device at or adjacent the top of the treatment vessel, comprising: a) Causing comminuted cellulosic fibrous material to flow downwardly through the isolation device into the treatment vessel in a flow path. b) Selectively at least one of deflecting, substantially unencumbering, or substantially preventing, the flow from a) at a plurality of positions around the flow path so as to cause the material to establish a relatively flat top profile in the treatment vessel so that the material will be more uniformly treated in the treatment vessel, or have the treatment time thereof extended, than if a non-relatively flat, for example, sharply conical top profile were established. And, c) substantially uniformly treating the material in the treatment vessel.

The method may be practiced utilizing a plurality of gates disposed around the flow path, and b) may be practiced by individually moving the gates to partially or substantially fully open, or partially or substantially fully closed, all or selected portions of the flow path. Typically b) is further practiced by automatically individually moving the gates, typically by moving at least three polygonal shaped gates, such as individually moving four triangular shaped gates. The method may be practiced utilizing a fluid controlled piston and cylinder assembly attached to each gate, in which case b) is further practiced by controlling the supply of pressurized fluid to the piston and cylinder assemblies to individually control the positions of the gates attached thereto.

Typically c) is practiced by steaming the material in the pile in the treatment vessel, and b) is typically practiced at least in part in response to sensing of the level of material in the treatment vessel, such as by sensing the top profile of material in the treatment vessel. Where the isolation device is a distinct vessel above the treatment vessel, b) may be practiced in part in response to sensing of the level of material in the isolation device. For example b) is practiced by controlling the gates so that they open and close for a predetermined period of time ranging between about one second and ten minutes, typically between about five seconds and five minutes, for example between about fifteen seconds and one minutes, in a predetermined sequence.

According to another aspect of the present invention there is provided a system for treating comminuted cellulosic fibrous material, comprising: A treatment vessel having a top and a bottom. An inlet for comminuted cellulosic fibrous material at or adjacent the top, typically including an isolation device. A plurality of individually controlled gates each movable between a position in which it is substantially completely closed and a position in which it is substantially fully open, or to at least some positions between these extremes (e.g. substantially any position between fully open and closed). The gates mounted below the inlet, so as to deflect, not significantly affect, or substantially preclude the flow of material therepast into the vessel, depending upon the positions thereof. And, an individual actuator for each of the gates.

The plurality of gates typically comprises at least three substantially polygonal shaped gates, such as four substantially triangular shaped gates. The actuators may comprise pneumatic or hydraulic piston and cylinder assemblies, and there may further be an automatically controlled valve operatively connected to each of the actuators that control the flow of pressurized fluid thereto. A sensor may be operatively connected to the valves for controlling the operation thereof, and/or the valves may be controlled by a timer. The sensor may comprise a level sensor for sensing the level of material in the treatment vessel; for example, the sensor may comprise a plurality of sensors disposed around the treatment vessel for sensing the top profile of a pile of material in the treatment vessel.

The isolation device may comprise a distinct vessel on top of the treatment vessel, and the system may further comprise a level sensor for sensing the level of material in the isolation device; a pressurized fluid supply tank operatively connected to the valves; and a flow control valve operatively connected to the supply tank and controlled in response to sensing of material level in the isolation device sensed by the level sensor. The treatment vessel typically includes treatment fluid introducing structures, preferably a treatment vessel comprising a chip bin and including at least one steam introduction device which introduces steam into the treatment vessel to steam the material therein.

According to another aspect of the present invention there is provided a system for treating comminuted cellulosic fibrous material, comprising: A treatment vessel having a top and a bottom. An inlet for comminuted cellulosic fibrous material at or adjacent the top. A plurality of individually controlled gates each movable and positionable between a position in which it is substantially completely closed and a position in which it is substantially fully open or to positions between these extremes (e.g. any position between fully open and closed). The gates mounted below the inlet, so as to deflect, not significantly affect, or substantially preclude the flow of material therepast into the vessel, depending upon the positions thereof. Means for selectively moving the gates (such as conventional individual mechanical, fluidic, and/or electric elements operatively connected to each gate) so as to cause the material to establish a relatively flat top profile in the treatment vessel so that the material will be more uniformly treated in the treatment vessel than if a non-relatively flat, for example, sharply conical, top profile were established. And, means for introducing treatment fluid (such as conventional steam nozzles, bars, or grids, or liquid spray heads or conduits or nozzles) into the treatment vessel so as to substantially uniformly treat the material in the treatment vessel. The inlet may include a means for isolating the interior of the vessel from the atmosphere, for example, an isolation device.

Thus the present invention provides an improved method and apparatus which distribute wood chips (or other comminuted cellulosic fibrous material) across the top of a retention vessel (e. g., chip bin) to improve the uniformity of the treatment or extend the time of the treatment in the vessel. This invention is typically applicable to the treatment of wood chips during their introduction to a chemical pulping process, but is applicable to any treatment or retention of any particulate matter (including non-cellulose particulate matter) for which better distribution in a vessel is desirable.

DETAILED DESCRIPTION OF THE DRAWINGS

Figure 1:
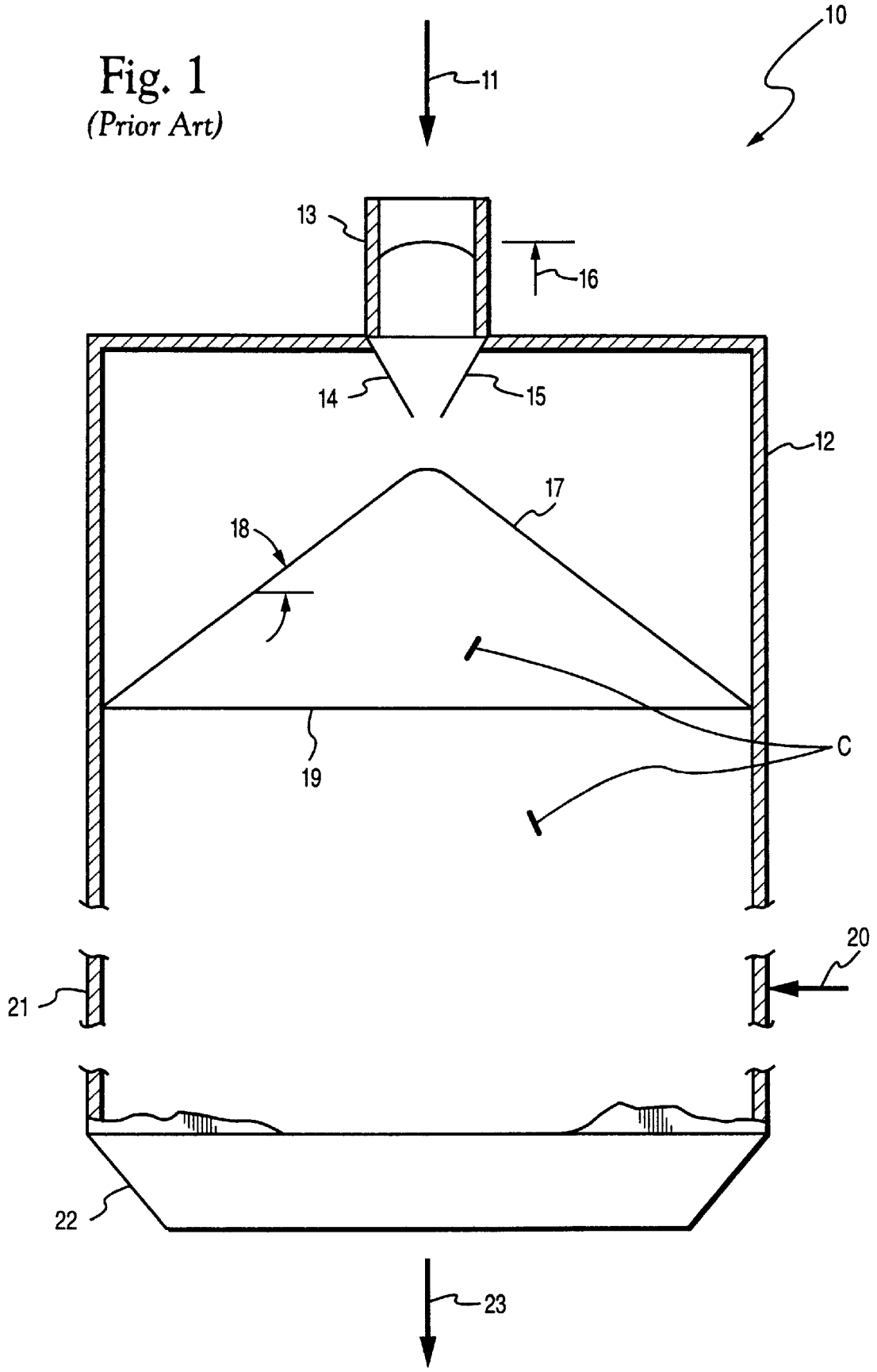
Fig. 1 (Prior Art)
FIG. 1 is a schematic illustration of an exemplary prior art vessel and system over which the present invention is an improvement.

FIG. 1 illustrates a typical prior art system 10 for introducing comminuted cellulosic fibrous material, that is, wood chips, 11 to a chemical pulping system. System 10 typically includes some form of retention vessel 12 and some form of isolation device 13 for isolating the environment within the vessel 12 from the ambient atmosphere and for minimizing the release of gases from the vessel while chips are being introduced. For example, retention vessel 11, may be a Chip Bin or a Diamondback® Steaming Vessel as sold by Ahistrom Machinery; isolation device 13 may be a conventional Airlock as also sold by Ahistrom Machinery. Isolation device 13 may also be a conventional rotary isolation device having a rotating rotor with pockets that accept and release chips.

The prior art system shown 10 shown in FIG. 1 includes a Airlock having two hinged gates or doors 14,15 as provided by Ahistrom Machinery. The deflection of these doors is typically controlled pneumatically or through counterweights to maintain a level of chips 16 above the doors, such as shown in U.S. Pat. No. 4,927,312. The deflection of the gates 14,15 may also synchronized, for example, by using a sprocket and chain assembly as shown in WO 96/17124. Maintaining this chip level 16 provides a chip mass which helps to prevent the passage of gasses out of the bin 11. This device which includes gates 14, 15, as well as other similar devices, such as rotary airlocks, typically introduce chips to the center of the bin such that a conical top pile of chips C is produced in the top of the bin 12. However, the size and density of the chips 11 can vary such that chips do not fall on the centerline of the bin. This conical pile typical has an angle of repose 18 of between 40 and 50 degrees, depending upon the flow characteristics of the material being handled. At some point below the top 17, of the pile of chips C, the chips C in the pile fill the cross-section of the bin, for example, at an elevation 19.

The chips C may be treated with steam or other gases in bin 12. For example, steam is typically introduced at one or more locations around the bin and at one or more elevations in the bin, as shown schematically by arrow 20 in FIG. 1. Steam is preferably introduced to a section 21 of the bin 12 below the elevation 19 where the cross section of the bin 12 is essentially completely filled with chips C. This steam 20 is typically introduced above the outlet 22 of the bin 12, though steam may also be introduced in the outlet 22. The outlet 22 passes the treated chips C in direction 23, with or without steaming, to further treatment. This further treatment may be, for example, pressurization via a pressure isolation device, such as a Low Pressure Feeder sold by Ahlstrom Machinery; metering via metering device, such as Chip Meter or Metering Screw as sold by Ahlstrom Machinery; or pressurized transferring to a further treatment using a conventional Slurry Pump and/or a conventional High Pressure Feeder as also supplied by Ahistrom Machinery. Ultimately, the chips are forwarded to a pulping vessel (e.g. a continuous or batch digester) where the chips are treated with pulping chemicals at temperature greater than 100 degrees C and at superatmospheric pressure, e.g., by the kraft or sulfite processes.

Figure 2:
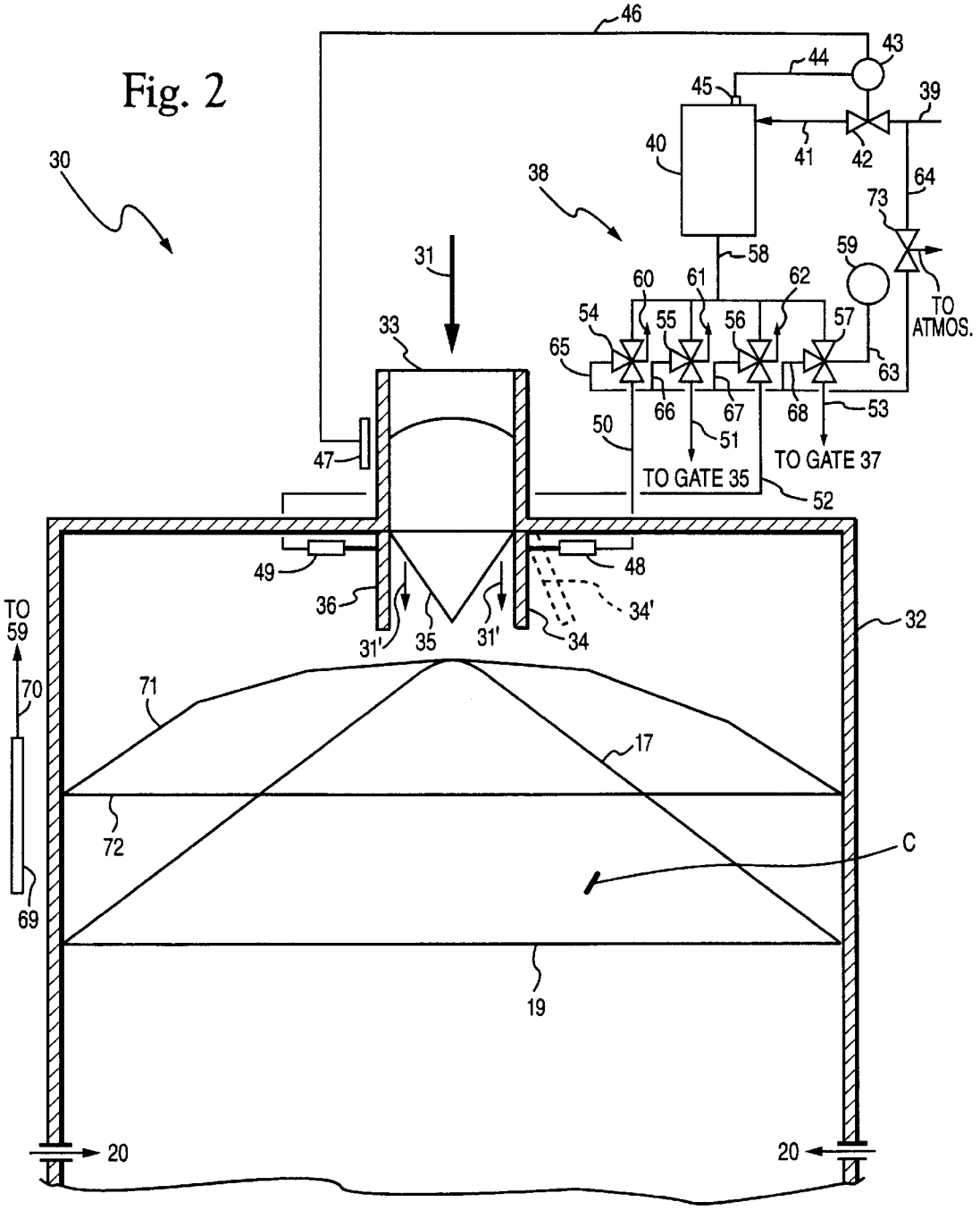
FIG. 2 is a schematic side cross-sectional view of one embodiment of an exemplary vessel and system for practicing an exemplary method according to the invention.

FIG. 2 schematically illustrates one exemplary embodiment of a system 30 according to the present invention. Similar to the system shown in FIG. 1, in system 30 chips 31, or other comminuted cellulosic fibrous material, is introduced to a cylindrical treatment or retention vessel 32 by an isolation device 33. The vessel 32 may have the same bottom and treatment fluid introducing devices as the vessel 12 of FIG. 1. However, unlike the prior art of FIG. 1, the isolation device 33 includes at least two, preferably three, most preferably four (or more), hinged gates or doors 34–37 which are independently and incrementally controlled. These gates are preferably substantially polygonal (most preferably substantially triangular) in shape and hinged along one edge adjacent to the bottom of device 33 such that when deflected toward each other, or closed, the gates form a pyramid-shape having an apex pointing toward the bin 32 below and a base forming the outlet of cylindrical isolation device 33. The movement of each gate is effected by any appropriate conventional form of electromechanical control device 38, which is preferably some form of pneumatic or hydraulic device (such as conventional pneumatic or hydraulic piston and cylinder assemblies) under some form of computer control. Movement can be past vertical, as shown at dotted line at 34' in FIG. 2, when a gate is substantially fully open.

The pneumatic control device 38 shown in FIG. 2 consists of or comprises a source of pressurized gas 39, which for this discussion will be assumed to be air but any form of appropriate pressurized gas may be used. The air is introduced to a pneumatic accumulator or pressurized air supply tank 40 via conduit 41. The pressure in the tank 40 and the flow of air to the tank 40 through conduit 41 is controlled to a preset value by a pressure control valve 42 which is controlled by a pressure controller 43 which receives a pressure signal 44 from a pressure sensor 45 mounted on tank 40. Controller 43 may also receive an electrical signal 46 provided by a level indicator 47, for example, a gamma radiation detector or other conventional appropriate level detector, mounted to isolation device 33 which detects the level of chips sensed by sensor 47 in isolation device 33. The signal 46 may also be introduced manually, for example, based upon visual observation of the level of chips in isolation device 33 made directly by a human operator or indirectly by some form of remote sensing device, for example, a video camera. A human operator may also input the signal 46 via a computer console.

The pressurized air provided in tank 40 is fed via conduit 58 to the two or more, preferably, three or more, pneumatic actuators (e.g., 48, 49) that control the deflection of two or more gates 34–37. In the system shown in FIG. 2 there are four gates 34, 35, 36, and 37, but only actuators 48 and 49 which control gates 34 and 36, respectively, are shown in FIG. 2, for ease of illustration. The actuators that control gates 35 and 37 are preferably similar, if not identical, to actuators 48, 49. The actuators 48 and 49 are illustrated as pneumatically-controlled piston actuators attached to gates 34 and 36 by an appropriate connection, for example, with appropriate supports, bearings, linkages and other hardware as necessary, though any suitable attachment to the gates 34–37 may be used and the exact actual attachment is not critical to the present invention. For example, the actuators 48, 49 could be cams or linear screws with traveling ball bearing assemblies controlled by electric motors.

Pneumatic pressure is supplied to the actuators, for example, actuators 48 and 49, by conduits 50, 51, 52, and 53. The flow through conduits 50–53, is preferably regulated by automatic flow control valves 54, 55, 56, and 57, respectively. Valves 54–57 receive a control signal from controller 59 via the electrical signals 60, 61, 62, and 63, respectively. For simplicity, only signal 63 is shown connected to controller 59, signals 60–63 make similar connections to controller 59. Controller 59 (which is conventional per se and preferably includes a built in timer) controls the operation of valves 54–57 to either pass the pressurized air tank 40 to the gate actuators, for example, 48 and 49, via conduits 50–53, or to direct the pressurized air in supply conduit 39 directly to conduits 50–53 via conduit 64 and conduits 65, 66, 67, and 68. Conduit 64 typically supplies unregulated pressurized air from supply conduit 39. Conduit 64 also includes a valve 73 for discharging to atmosphere such that the pressure in conduits 65–68 and 50–53 can be vented to atmosphere and the actuators 48, 49 unpressurized. Valve 73 may also be controlled by controller 59. The signals 60–63 provided by controller 59 may be in response to a level control signal 70 from level indicator 69 of chip level 71 in vessel 32, a level control signal or switch 47 on isolation device 33, and/or the desired signals may be determined by manual input from a human operator based upon visual observation of the level 71 or other operating parameters. The deflection of the gates 34–37 may also be assisted by conventional (preferably adjustable) counter-weights attached to the gates 34–37.

One or more level sensors 69, or the like, may be provided around the periphery of the vessel 32 to essentially sense the profile of the top of the pile C, to facilitate automatic control of the valves 54–57 to in turn control the actuators 48, 49, etc., to control the gates 34–37 so as to optimize the top profile 71 of the pile C.

In the preferred mode of operation of the system 30, the deflection of the gates 34–37 is synchronized so that the distribution of the incoming chips 31 is more uniform across the cross section of vessel 32 while symmetric about the axis of the vessel 32. For example, instead of the chip pile top profile 17 shown in FIG. 1, and shown for reference in FIG. 2, the preferred chip pile top profile 71 is established. For top profile 71, the elevation of the point 72 where the chip pile C contacts the vessel wall 32 is higher than the point 19 the chip pile contacts the wall in the prior art system 10. In the most preferred situation the point (elevation/height) 72 at which the chips contact the vessel wall 32 approaches and possibly matches the elevation of the top 71 of the chip pile C. Thus, compared to the prior art, the treatment time, for example, steaming time, of chips above elevation 19 is extended by having a more completely filled cross section up to an elevation 72.

There are several modes of operation for the system shown in FIG. 2. Typically the flow of air from accumulator tank 40 is regulated by controller 59 and valves 54–57 so that the pressure in tank 40, which is controlled in response to the level detected by detector 47, is applied to one or more actuators, for example, 48 and 49, so that deflection of the gates 34–37 is controlled by the level in isolation device 33 or the level in vessel 32. The pressure applied to the actuators 48, 49 may also be controlled by the height of the chip level 71, for example, by a level switch. In these cases the gate 34–37 deflections are "controlled" by the pressure in tank 40 or other control devices, including but not limited to those described above. In addition, the controller 59 directs valves 54–57 to apply the air pressure in conduit 39, via conduits 64, and 65–68, to conduits 50–53 so that the actuators 48, 49 are pressurized and the gates 34–37 are opened, deflected or closed, or "locked" in position. Also, the valve 73 can be vented to atmosphere so that the pressure to the actuators 48, 49 is released or "dumped" to atmosphere and the gate 34–37 associated therewith returns to an unpressurized open position; the unpressurized position may also be a closed position.

Figure 3A:
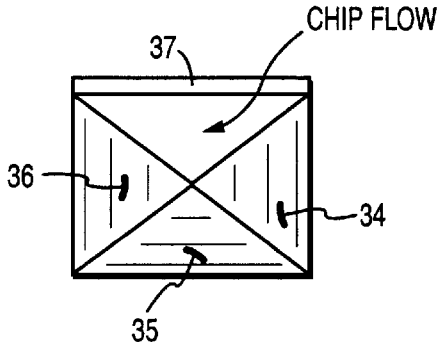
FIGS. 3*a*–3*d* are top plan schematic views of the gates of the system of FIG. 2 in various exemplary positions of openness, so as to control the flow of chips into the vessel of FIG. 2 and thereby establish a higher level, more flat, profile of chips in the vessel.
Figure 3B:
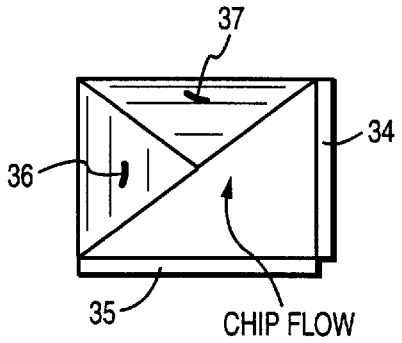
Figure 3C:
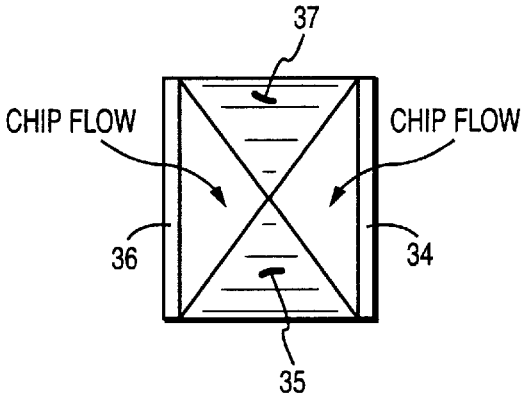
Figure 3D:
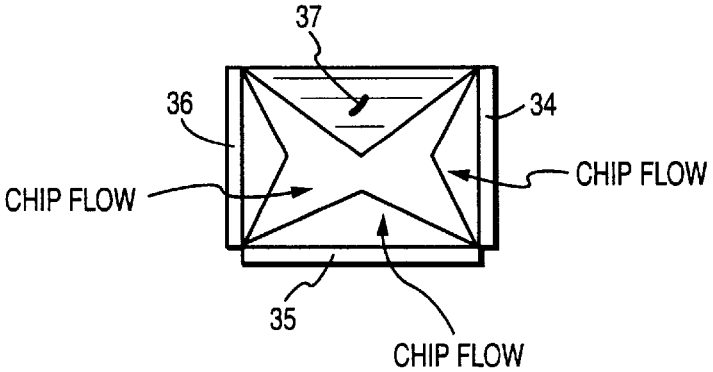

FIGS. 3A–3D are top plan schematic views of the gates 34–37 (when four such gates are provided), each having a substantially triangular shape, shown in various positions to deflect the flow of chips into the pile C so as to establish the top profile 71, instead of the top profile 17 which occurs when simply two gates are either opened or closed as is conventional in the prior art system of FIG. 1. In FIG. 3A the gate 37 is fully open, while the gates 34–36 are fully closed, all under control of the actuators connected thereto (such as the pneumatic piston and cylinder assemblies 48, 49 of FIG. 2), which causes chips to flow toward one quadrant of the vessel 32, but not the others. FIG. 3B shows the gates 36, 37 closed and gates 34, 35 fully open so that chips only flow toward two adjacent quadrants of vessel 32. FIG. 3C shows opposite gates 34, 36 substantially fully open, and opposite gates 35, 37 substantially completely closed so that chips only flow toward two opposite quadrants of vessel 32. FIG. 3d shows three gates 34–36 only partially open, and one gate 37 completely closed, so that the chips flow partially into three adjacent quadrants of the vessel 32. By manually or automatically controlling the positions of all of the gates 34–37 (so that they are at various degrees of openness including substantially fully open, or substantially completely closed) it is possible to cause the chips to form a pile C with the top profile 71 instead of the top profile 17.

By controlling the positions of the gates 34–37 one can practice a method of treating comminuted cellulosic fibrous material, including by controlling the top profile of comminuted cellulosic fibrous material established in a vessel having an isolation device at or adjacent the top of the vessel, comprising:

a) causing comminuted cellulosic fibrous material 31 to flow downwardly through the isolation device 33 into the vessel 32 in a flow path 31';

b) selectively deflecting, substantially unencumbering, or substantially preventing, the flow from a) at a plurality of positions around the flow path 31' (typically by varying the positions of the gates 34–37 using the actuators 48, 49, etc., such as described above with respect to FIGS. 3A–3D) so as to cause the material to establish a pile C having a relatively flat, non-conical, top profile 71 in the vessel 32 so that the material will be more uniformly treated in the vessel than if a conical top profile 17 were established; and c) substantially uniformly treating the material in the vessel 32 (e. g. by steaming the material when in pile C by introducing steam at 20).

In one mode, referred to as "Single Gate Level Control", one or more gates 34–37 are operated in sequence, using a timer built in to the controller 59, for example in the following sequence:

a) For a time x, gate 34 is controlled by the level in isolation device 33 to fully open, gates 35–37 are "locked" in deflected position.

b) For a time y, gates 34 and 35 are controlled (i.e. substantially fully opened), gates 36 and 37 are locked.

c) For a time x, gate 35 is controlled by the level in device 33, gates 34, 36 and 37 are locked.

d) For a time y, gates 35 and 36 are controlled, gates 34 and 37 are locked.

e) For a time x, gate 36 is controlled, gates 34, 35 and 37 are locked.

f) For a time y, gates 36 and 37 are controlled, gates 34 and 35 are locked.

g) For a time x, gate 37 is controlled, gates 34,35 and 36 are "locked".

h) For a time y, gates 37 and 34 are controlled, gates 35 and 36 are locked.

i) Repeat a) through h).

The times x and y each typically vary from one second to ten minutes, preferably from about five seconds to five minutes, most preferably from about fifteen seconds to one minute, depending upon the flow pattern and sequencing desired, and are predetermined in the controller 59.

Another mode of operation, referred to as "Multiple Gate Level Control", consists of or comprises the following sequence:

a) For a time x, all gates, 34–37, are controlled (i.e. substantially fully opened).

b) For a time y, pressure is dumped from gate 34.

c) For a time x, all gates 34–37 are controlled.

d) For a time y, pressure is dumped from gate 35.

e) For a time x, all gates 34–37 are controlled.

f) For a time y, pressure is dumped from gate 36.

g) For a time x, all gates 34–37 are controlled.

h) For a time y, pressure is dumped from gate 37.

i) Repeat a) through h).

The times x and y are preferably the same as described above (e. g. each varying from about one second to ten minutes, etc.).

Other modes of operation are conceivable based upon the desired geometry of the chip profile and are included within the scope of this invention.

In the application, all structures or procedures described as "consisting of" may also be described as "comprising", the structures or procedures either being restricted to what is recited, or containing what is recited as a just one element or procedure. Also within the scope of the invention are any and all narrower ranges within any broad range recited. The invention is to be given the broadest interpretation possible constrained only by the prior art.

What is claimed is:

1. A system for treating comminuted cellulosic fibrous material, comprising:

a treatment vessel having a top and a bottom;

an inlet for comminuted cellulosic fibrous material at or adjacent said top;

a plurality of individually controlled gates mounted below said inlet, so as to deflect, not significantly affect, or substantially preclude the flow of material therepast into said vessel, depending upon the positions thereof;

said plurality of individually controlled gates each movable between a position in which it is substantially completely closed and a position in which it is substantially fully open; and at least some positions between fully open and closed; and an individual actuator for each of said gates.

2. A system as recited in claim 1 wherein said actuators comprise pneumatic or hydraulic piston and cylinder assemblies.

3. A system as recited in claim 2 further comprising an automatically controlled valve operatively connected to each of said actuators to control the flow of pressurized fluid thereto.

4. At A system as recited in claim 3 further comprising a sensor operatively connected to said valves for controlling operation thereof.

5. A system as recited in claim 4 wherein said sensor comprises a level sensor for sensing the level of material in said treatment vessel.

6. A system as recited in claim 4 wherein said sensor comprises a plurality of sensors disposed around said treatment vessel for sensing the top profile of a pile of material in said treatment vessel.

7. A system as recited in claim 1 further comprising an isolation device which isolates the interior of said vessel from the atmosphere.

8. A system as recited in claim 7 wherein said isolation device comprises a distinct vessel on top of said treatment vessel; and further comprising an automatically controlled valve operatively connected to each of said actuators to control the flow of pressurized fluid thereto; a level sensor for sensing the level of material in said isolation device; a pressurized fluid supply tank operatively connected to said valves; and a flow control valve operatively connected to said supply tank and controlled in response to sensing of material level in said isolation device sensed by said level sensor.

9. A system as recited in claim 1 wherein said treatment vessel includes at least one steam introduction device which introduces steam into said treatment vessel to steam the material therein.

10. A system as recited in claim 1 wherein said plurality of gates comprises at least three substantially polygonal shaped gates.

11. A system as recited in claim 2 wherein said plurality of gates comprises four substantially triangular shaped gates.

12. A system as recited in claim 3 further comprising a timer for controlling the operation of said valves.

13. A system for treating comminuted cellulosic fibrous material, comprising:

a treatment vessel having a top and a bottom;

an inlet for comminuted cellulosic fibrous material at or adjacent said top, and including an isolation device;

a plurality of individually controlled Sates mounted below said inlet, so as to deflect, not significantly affect, or substantially preclude the flow of material therepast into said vessel, depending upon the positions thereof;

said plurality of individually controlled gates each movable and positionable between a position in which it is substantially completely closed and a position in which it is substantially fully open;

means for selectively moving said gates so as to cause the material to establish a relatively flat top profile in said treatment vessel so that the material will be more uniformly treated in said treatment vessel than if a relatively non-flat top profile were established; and means for introducing treatment fluid into said treatment vessel so as to substantially uniformly treat the material in said treatment vessel.

14. A system as recited in claim 13 wherein said individually controlled gates are movable and positionable in substantially any position between fully open and fully closed.

15. A system as recited in claim 13 wherein said plurality of gates comprises at least three substantially polygonal shaped gates.

16. A system as recited in claim 13 wherein said plurality of gates comprises four substantially triangular shaped gates.

17. A system as recited in claim 13 further comprising an isolation device which isolates the interior of said vessel from the atmosphere.

18. A system as recited in claim 17 wherein an isolation device comprises a distinct vessel on top of said treatment vessel.

19. A system as recited in claim 13 wherein said treatment vessel includes at least one steam introduction device which introduces steam into said treatment vessel to steam the material therein.

20. A system as recited in claim 2 wherein said plurality of gates comprises at least three substantially polygonal shaped gates.

21. A system as recited in claim 1 wherein said plurality of gates comprises four substantially triangular shaped gates.

22. A system as recited in claim 13 wherein said means for selectively moving said gates includes an automatically controlled valve operatively associated with each of said gates and individually controllable.

23. A system as recited in claim 22 further comprising a sensor operatively connected to said valves for controlling operation thereof.

24. A system as recited in claim 23 wherein said sensor comprises a level sensor for sensing the level of material in said treatment vessel.

25. A system as recited in claim 23 wherein said sensor comprises a plurality of sensors disposed around said treatment vessel for sensing the top profile of a pile of material in said treatment vessel.

26. A system as recited in claim 22 further comprising a timer for controlling the operation of said valves.

27. A system as recited in claim 4 further comprising a timer for controlling the operation of said valves.

* * * * *

UNITED STATES PATENT AND TRADEMARK OFFICE

CERTIFICATE OF CORRECTION

PATENT NO. : 6,143,134
DATED : November 7, 2000
INVENTOR(S) : Prough

It is certified that error appears in the above-identified patent and that said letters patent is hereby corrected as shown below:

Column 3, line 38, "one minutes" should read --one minute--.

Column 5, line 6, "retention vessel 11" should read --retention vessel 12--.

Column 5, line 22, "bin 11" should read --bin 12--.

Column 9, line 53, (claim 4) "At A" should read --A--.

Column 10, line 26, "controlled Sates" should read --controlled gates--.

Signed and Sealed this

Eighth Day of May, 2001

*Attest:*

Nicholas P. Godici

NICHOLAS P. GODICI

*Attesting Officer*

*Acting Director of the United States Patent and Trademark Office*